US009790780B2

(12) United States Patent
Dykstra et al.

(10) Patent No.: US 9,790,780 B2
(45) Date of Patent: Oct. 17, 2017

(54) DIRECTIONAL DRILLING METHODS AND SYSTEMS EMPLOYING MULTIPLE FEEDBACK LOOPS

(71) Applicant: HALLIBURTON ENERGY SERVICES, INC., Houston, TX (US)

(72) Inventors: Jason D. Dykstra, Spring, TX (US); Yuzhen Xue, Humble, TX (US); Fanping Bu, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/329,537

(22) PCT Filed: Sep. 16, 2014

(86) PCT No.: PCT/US2014/055945

§ 371 (c)(1),
(2) Date: Jan. 26, 2017

(87) PCT Pub. No.: WO2016/043724

PCT Pub. Date: Mar. 24, 2016

(65) Prior Publication Data

US 2017/0218744 A1 Aug. 3, 2017

(51) Int. Cl.
*E21B 44/00* (2006.01)
*E21B 7/06* (2006.01)
(Continued)

(52) U.S. Cl.
CPC ..... *E21B 44/00* (2013.01); *E21B 7/06* (2013.01); *E21B 47/0006* (2013.01); *E21B 47/024* (2013.01); *E21B 47/09* (2013.01)

(58) Field of Classification Search
CPC ..... E21B 44/00; E21B 47/024; E21B 47/09; E21B 47/0006; E21B 7/06
See application file for complete search history.

(56) References Cited

U.S. PATENT DOCUMENTS 4,903,245 A 2/1990 Close et al.
5,058,077 A 10/1991 Twist
(Continued)

FOREIGN PATENT DOCUMENTS

WO 2013/101984 7/2013

OTHER PUBLICATIONS

PCT International Search Report and Written Opinion, dated Jun. 18, 2015, Appl No. PCT/US2014/055945, "Directional Drilling Methods and Systems Employing Multiple Feedback Loops," Filed Sep. 16, 2014, 14 pgs.
(Continued)

*Primary Examiner* — Blake Michener
(74) *Attorney, Agent, or Firm* — John W. Wustenberg; Tumey L.L.P.

(57) ABSTRACT

A directional drilling system includes a bottomhole assembly having a drill bit and a steering tool configured to adjust a drilling direction in real-time. The system also includes a first feedback loop that provides a first steering control signal to the steering tool, and a second feedback loop that provides a second steering control signal to the steering tool. The system also includes a set of sensors to measure at least one of strain and movement at one or more points along the bottom-hole assembly during drilling, wherein the first and second steering control signals are based in part on the strain or movement measurements.

16 Claims, 6 Drawing Sheets

(51) Int. Cl.

| | |
|---|---|
| ***E21B 47/007*** | (2012.01) |
| ***E21B 47/09*** | (2012.01) |
| ***E21B 47/00*** | (2012.01) |
| ***E21B 47/024*** | (2006.01) |

(56) References Cited

U.S. PATENT DOCUMENTS

| | | | | |
|---|---|---|---|---|
| 5,220,963 | A | 6/1993 | Patton | |
| 5,269,383 | A | 12/1993 | Forrest | |
| 5,332,048 | A | 7/1994 | Underwood et al. | |
| 6,244,361 | B1 | 6/2001 | Comeau et al. | |
| 6,405,808 | B1 | 6/2002 | Edwards et al. | |
| 6,415,878 | B1 | 7/2002 | Cargill et al. | |
| 6,691,804 | B2 | 2/2004 | Harrison | |
| 6,769,499 | B2 | 8/2004 | Cargill et al. | |
| 6,942,043 | B2 | 9/2005 | Kurkoski | |
| 6,968,909 | B2 | 11/2005 | Aldred et al. | |
| 7,142,986 | B2 | 11/2006 | Moran | |
| 7,172,037 | B2 | 2/2007 | Dashevskiy et al. | |
| 7,178,608 | B2 | 2/2007 | Mayes et al. | |
| 7,313,480 | B2 | 12/2007 | Chen et al. | |
| 7,503,403 | B2 | 3/2009 | Jogi et al. | |
| 7,571,643 | B2 | 8/2009 | Sugiura | |
| 7,588,082 | B2 | 9/2009 | Lasater | |
| 7,921,937 | B2 | 4/2011 | Brackin et al. | |
| 8,260,554 | B2 | 9/2012 | Morys | |
| 8,376,065 | B2 | 2/2013 | Teodorescu et al. | |
| 8,561,720 | B2 | 10/2013 | Edbury et al. | |
| 8,602,126 | B2 | 12/2013 | Boone et al. | |
| 2002/0020561 | A1* | 2/2002 | Alft | E21B 7/06 175/48 |
| 2003/0111268 | A1* | 6/2003 | Alft | E21B 7/046 175/73 |
| 2005/0006145 | A1* | 1/2005 | Downton | E21B 7/04 175/45 |
| 2006/0254819 | A1 | 11/2006 | Moriarty | |
| 2008/0135290 | A1* | 6/2008 | Hopwood | E21B 44/00 175/24 |
| 2010/0108384 | A1* | 5/2010 | Byreddy | E21B 44/00 175/27 |
| 2010/0175922 | A1 | 7/2010 | Ignova et al. | |
| 2010/0259415 | A1* | 10/2010 | Strachan | E21B 44/00 340/853.6 |
| 2010/0314173 | A1 | 12/2010 | Hbaieb et al. | |
| 2012/0046868 | A1 | 2/2012 | Tchakarov et al. | |
| 2012/0130693 | A1* | 5/2012 | Ertas | E21B 44/00 703/2 |
| 2013/0048383 | A1 | 2/2013 | Panchal et al. | |
| 2013/0126239 | A1 | 5/2013 | Panchal et al. | |
| 2013/0161096 | A1* | 6/2013 | Benson | E21B 7/04 175/26 |
| 2013/0341095 | A1 | 12/2013 | Perrin et al. | |
| 2014/0338974 | A1* | 11/2014 | Trichel | E21B 44/00 175/27 |

OTHER PUBLICATIONS

PCT International Preliminary Report on Patentability, dated Aug. 16, 2016, Appl No. PCT/US2014/055945, "Directional Drilling Methods and Systems Employing Multiple Feedback Loops," Filed Sep. 16, 2014, 4 pgs.

* cited by examiner

DIRECTIONAL DRILLING METHODS AND SYSTEMS EMPLOYING MULTIPLE FEEDBACK LOOPS

BACKGROUND

During oil and gas exploration and production, many types of information are collected and analyzed. The information is used to determine the quantity and quality of hydrocarbons in a reservoir, and to develop or modify strategies for hydrocarbon production. These exploration and production efforts generally involve drilling boreholes, where at least some of the boreholes are converted into permanent well installations such as production wells, injections wells, or monitoring wells.

Many drilling projects involve concurrent drilling of multiple boreholes in a given formation. As such drilling projects increase the depth and horizontal reach of such boreholes, there is an increased risk that such boreholes may stray from their intended trajectories and, in some cases, collide or end up with such poor placements that one or more of the boreholes must be abandoned. Measurement-while-drilling (MWD) survey techniques can provide information to guide such drilling efforts.

While using survey data to guide drilling can help to improve a borehole's trajectory, it also results in drilling delays. Currently, real-time control of drilling operations based on survey data alone is not possible. There are several reasons for this. First, even fast surveys (e.g., to acquire bit toolface, inclination, and azimuth/direction angles) take minutes. In addition, the survey data is often sent to surface after a still time (e.g., 3 minutes after drilling operations are halted). Further, the amount of survey data that can be transmitted to the surface is limited to due to communication bandwidth restrictions. Further, new directional drilling commands take time to determine and to transmit from the surface to the bottomhole assembly (BHA). Currently, surveys are acquired along a borehole path at locations spaced at least 30 ft apart with no drill path data available between the survey locations. While collecting surveys at smaller intervals is possible, drilling delays increase in proportion to the amount of survey data being collected and/or the frequency of performing surveys to guide drilling.

BRIEF DESCRIPTION OF THE DRAWINGS

Accordingly, there are disclosed in the drawings and the following description various directional drilling methods and systems employing multiple feedback loops. In the drawings.

Figure 1:
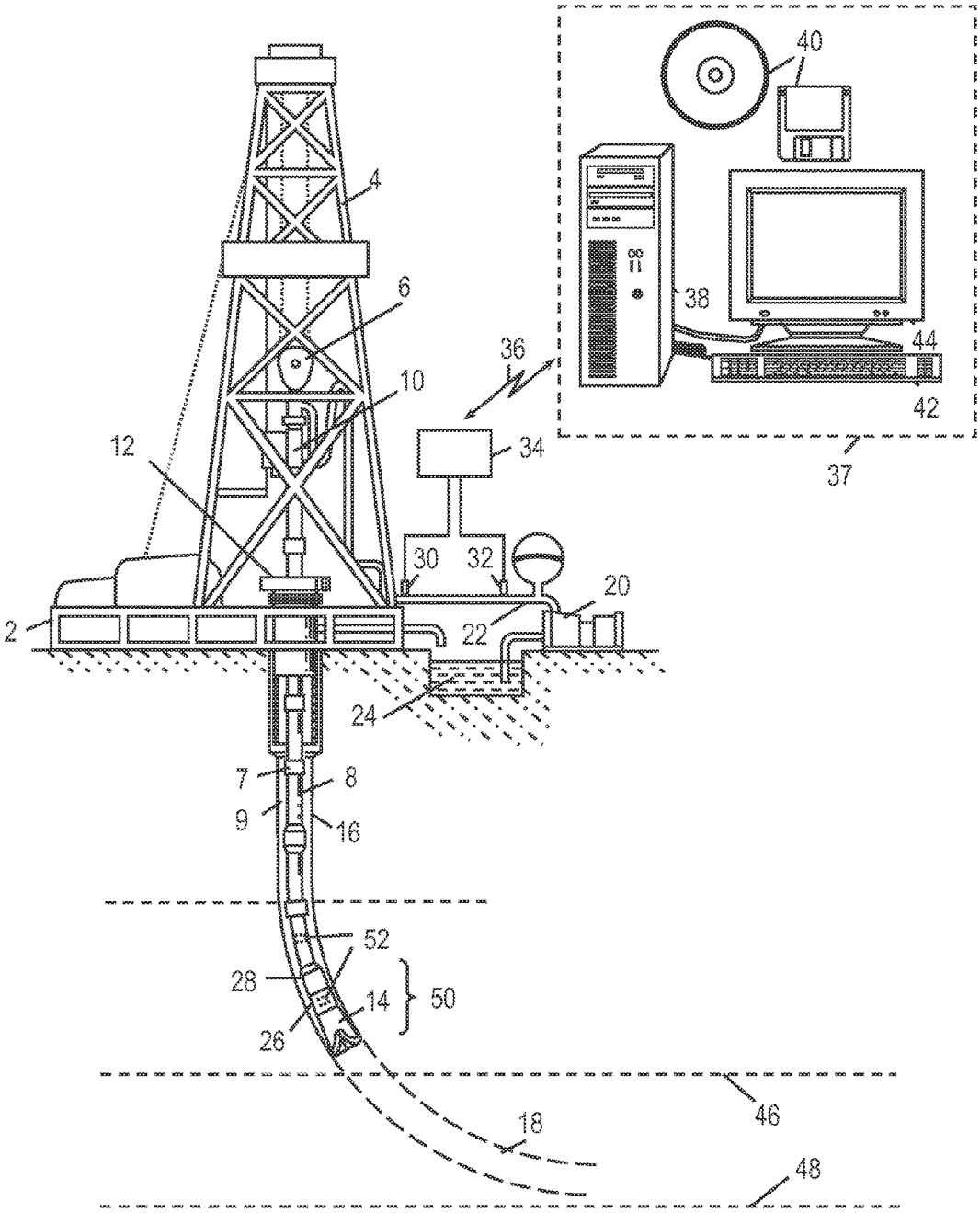
FIG. 1 is schematic diagram showing a directional drilling environment.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are various directional drilling methods and systems employing multiple feedback loops. An example directional drilling system includes a bottomhole assembly (BHA) having a drill bit and a steering tool configured to adaptively control a drilling direction. The system also includes a first feedback loop (e.g., a feedback loop that extends to earth's surface) that provides a first control signal to the steering tool, and a second feedback loop (e.g., a downhole feedback loop) that provides a second control signal to the steering tool. The system also includes a set of sensors to measure at least one of strain and movement at one or more points along the bottomhole assembly during drilling, where the first and second steering control signals are based in part on the strain or movement measurements.

In at least some embodiments, the first feedback loop provides the first control signal to the steering tool based in part on measurement-while-drilling (MWD) survey data (e.g., bit toolface, inclination, and azimuth/direction data) that is only periodically available (e.g., every 30 feet or so). For example, the first control signal may be adjusted as needed (e.g., when path deviation exceeds a threshold) based on the difference between a desired borehole path and a measured borehole path estimated from the MWD survey data. Meanwhile, the second control signal is provided by the second feedback loop to the steering tool more often than the first control signal and enables small directional drilling updates without waiting for new drilling instructions from the surface.

In at least some embodiments, the second feedback loop includes a proportional-integral-derivative (PID) controller that receives the difference between a measured drill bit position and an estimated drill bit position as input. Further, the output of the PID controller may be adjusted based on a bit force disturbance compensation to account for detectable issues such as stick-slip, bit wear, and formation changes. Inverse kinematics may be applied to the difference between the PID controller output and the bit force disturbance compensation to determine the second control signal. Such bit force disturbance compensation may be determined in part from the measurements of strain or movement at one or more points along the BHA during drilling, and is decoupled from the PID controller design (i.e., the PID controller does not need to account for bit force disturbance). Accordingly, the PID controller can stabilize the system more quickly compared to a PID controller that accounts for bit force disturbance. Using both the first feedback loop and the second feedback loop together to direct a steering tool expedites directional drilling operations while reducing dog-leg severity and/or other undesirable drilling issues.

To further assist the reader's understanding of the disclosed systems and methods, a directional drilling environment is illustrated in FIG. 1. A drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As bit 14 rotates, it creates a borehole 16 that passes through various formations. The drill bit 14 is just one piece of a BHA 50 that typically includes one or more drill collars (thick-walled steel pipe) to provide weight and rigidity to aid the drilling process. Some of these drill collars may include a logging tool 26 to gather MWD survey data such as position, orientation, weight-on-bit, borehole diameter, resistivity, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. Further, strain and movement measurements may be collected from sensors 52 integrated with the BHA 50 and/or drill string 8.

In FIG. 1, the MWD survey data collected by logging tool 26 as well as the strain and movement measurements collected by sensors 52 can be used to steer the drill bit 14 along a desired path 18 relative to boundaries 46, 48 using any one of various suitable directional drilling systems that operate in real-time. Example steering mechanisms include steering vanes, a "bent sub," and a rotary steerable system. During drilling operations, a pump 20 circulates drilling fluid through a feed pipe 22 to top drive 10, downhole through the interior of drill string 8, through orifices in drill bit 14, back to the surface via the annulus 9 around drill string 8, and into a retention pit 24. The drilling fluid transports cuttings from the borehole 16 into the pit 24 and aids in maintaining the borehole integrity. Moreover, a telemetry sub 28 coupled to the downhole tools 26 can transmit telemetry data to the surface via mud pulse telemetry. A transmitter in the telemetry sub 28 modulates a resistance to drilling fluid flow to generate pressure pulses that propagate along the fluid stream at the speed of sound to the surface. One or more pressure transducers 30, 32 convert the pressure signal into electrical signal(s) for a signal digitizer 34. Note that other forms of telemetry exist and may be used to communicate signals from downhole to the digitizer. Such telemetry may employ acoustic telemetry, electromagnetic telemetry, or telemetry via wired drill pipe.

The digitizer 34 supplies a digital form of the pressure signals via a communications link 36 to a computer system 37 or some other form of a data processing device. In at least some embodiments, the computer system 37 includes a processing unit 38 that performs analysis of MWD survey data and/or performs other operations by executing software or instructions obtained from a local or remote non-transitory computer-readable medium 40. The computer system 37 also may include input device(s) 42 (e.g., a keyboard, mouse, touchpad, etc.) and output device(s) 44 (e.g., a monitor, printer, etc.). Such input device(s) 42 and/or output device(s) 44 provide a user interface that enables an operator to interact with the BHA 50, surface/downhole directional drilling components, and/or software executed by the processing unit 38. For example, the computer system 37 may enable an operator may select directional drilling options, to review or adjust collected MWD survey data (e.g., from logging tool 26), sensor data (e.g., from sensors 52), values derived from the MWD survey data or sensor data (e.g., measured bit position, estimated bit position, bit force, bit force disturbance, rock mechanics, etc.), BHA dynamics model parameters, drilling status charts, waypoints, a desired borehole path, an estimated borehole path, and/or to perform other tasks. In at least some embodiments, the directional drilling performed by BHA 50 is based on a surface feedback loop and a downhole feedback loop as described herein.

Figure 2A:
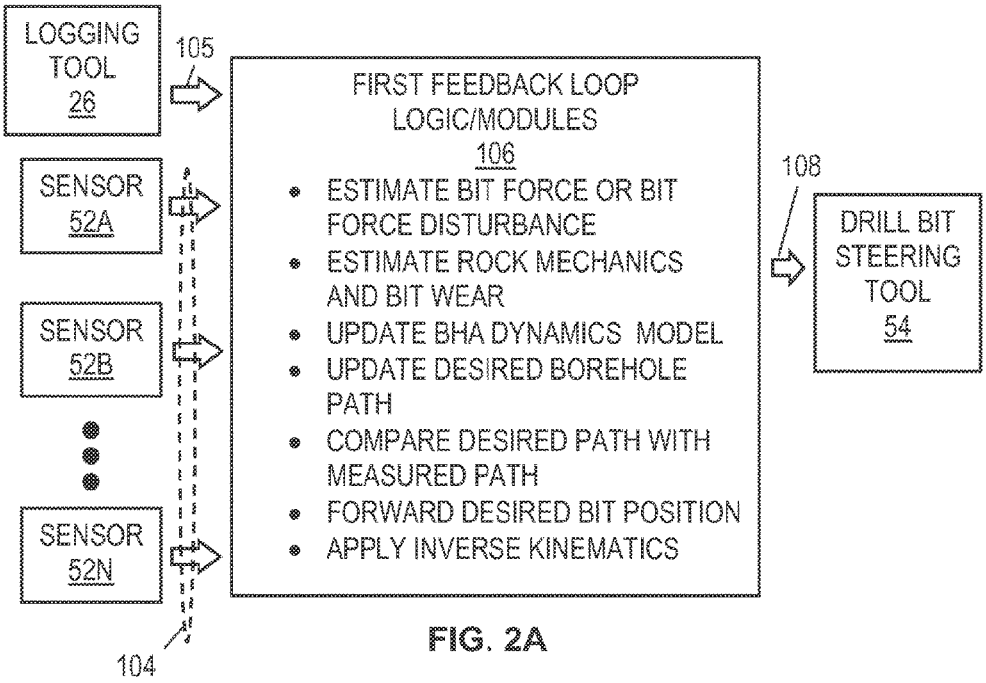
FIGS. 2A and 2B are block diagrams showing directional drilling control components.
Figure 2B:
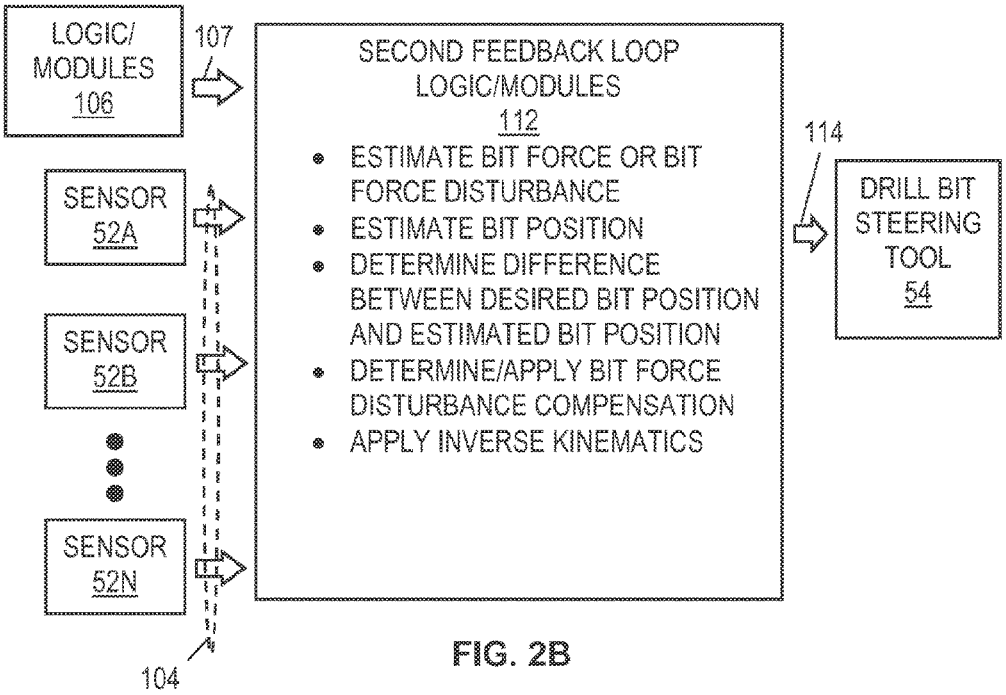

FIGS. 2A and 2B show illustrative directional drilling control components. More specifically, FIG. 2A represents a first control scheme for directional drilling, while FIG. 2B represents a second control scheme for directional drilling. In accordance with at least some embodiments, the first and second control schemes shown in FIGS. 2A and 2B are used together, where a steering control signal (e.g., signal 114) provided by the second control scheme of FIG. 2B is received by a drill bit steering tool 54 more often than a steering control signal (e.g., signal 108) provided by the first control scheme of FIG. 2A.

In FIG. 2A, a plurality of sensors 52A-52N provide a set of measurements 104 to first feedback loop logic/modules 106. For example, the set of measurements 104 may correspond to strain, acceleration, and/or bending moments collected at one or more points along BHA 50 and/or drill string 8. Further, the logging tool 26 provides MWD survey data 105 to the first feedback loop logic/modules 106. The first feedback loop logic/modules 106 correspond to hardware and/or software configured to perform various first feedback loop operations. While it is intended that at least some portion of the first feedback loop logic/modules 106 resides at earth's surface, it should be appreciated that not all of the first feedback loop logic/modules 106 need reside at earth's surface. For example, some of the first feedback loop logic/modules 106 may reside downhole with BHA 50 to control the amount/type of information that is transmitted to earth's surface. In different embodiments, the set of measurements 104 may be processed downhole or may be transmitted to earth's surface for processing. If the set of measurements 104 are processed downhole, parameters (e.g., bit force, bit force disturbance, rock mechanic estimates, bit wear, etc.) derived from the set of measurements 104 and/or other information may be transmitted to earth's surface with or without the set of measurements 104.

In accordance with at least some embodiments, the first feedback loop logic/modules 106 estimates a bit force or bit force disturbance from the set of measurements 104. Further, the first feedback loop logic/modules 106 may estimate rock mechanics and bit wear. Further, the first feedback loop logic/modules 106 may update a BHA dynamics module based on analysis of the rock mechanics, the bit wear estimates, and/or other data. Further, the first feedback loop logic/modules 106 may update a desired borehole path in response to the rock mechanics, the bit wear estimates, drilling models, and/or other data. Further, the first feedback loop logic/modules 106 may compare the latest desired borehole path with a measured borehole path (e.g., obtained from the MWD survey data 105). Further, the first feedback loop logic/modules 106 may forward a desired bit position to a second feedback loop. Further, the first feedback loop logic/modules 106 may apply inverse kinematics to the difference between the desired borehole path and the measured borehole path. The output of the inverse kinematics operation may correspond to a steering control signal 108 to a drill bit steering tool 54, which may correspond to part of BHA 50. As an example, the drill bit steering tool 54 may update cam positions used for steering based on steering control signal 108.

In FIG. 2B, the plurality of sensors 52A-52N provide the set of measurements 104 to second feedback loop logic/modules 112. Again, the set of measurements 104 may correspond to strain, acceleration, and/or bending moments collected at one or more points along BHA 50 and/or drill string 8. Further, the first feedback loop logic/modules 106 provide one or more inputs 107 to the second feedback loop logic/modules 112. For example, in at least some embodiments, the input 107 corresponds to a desired bit position. The second feedback loop logic/modules 112 correspond to hardware and/or software configured to perform various second feedback loop operations. It is intended that the second feedback loop logic/modules 112 reside downhole to ensure frequent updates to steering control signal 114. As an example, some or all of the logic/modules 104 may reside downhole with BHA 50.

Similar to the first feedback loop logic/modules 106, the second feedback loop logic/modules 112 estimate a bit force or bit force disturbance from the set of measurements 104. Accordingly, in some embodiments, the first feedback loop logic/modules 106 and the second feedback loop logic/modules 112 may share logic to perform the step of estimating a bit force or bit force disturbance from the set of measurements 104. Further, the second feedback loop logic/modules 112 may estimate a bit position from the set of measurements 104. Further, the second feedback loop logic/modules 112 may determine a difference between a desired bit position (e.g., input 107) and an estimated bit position. Further, the second feedback loop logic/modules 112 may determine and apply a bit force disturbance compensation. Further, the second feedback loop logic/modules 112 may apply inverse kinematics. The output of the inverse kinematics operation may correspond to steering control signal 114 for drill bit steering tool 54, which corresponds to part of BHA 50. For example, the drill bit steering tool 54 may update cam positions used for steering based on steering control signal 114.

In at least some embodiments, the second feedback loop logic/modules 112 include a PID controller that receives the difference between the desired bit position (e.g., input 107) and the estimated bit position. The determined bit force disturbance compensation determined by the second feedback loop logic/modules 112 is applied to the output of the PID controller. For this PID controller configuration, the inverse kinematics operations are performed on difference between the PID controller output and the bit force disturbance compensation.

Figure 3:
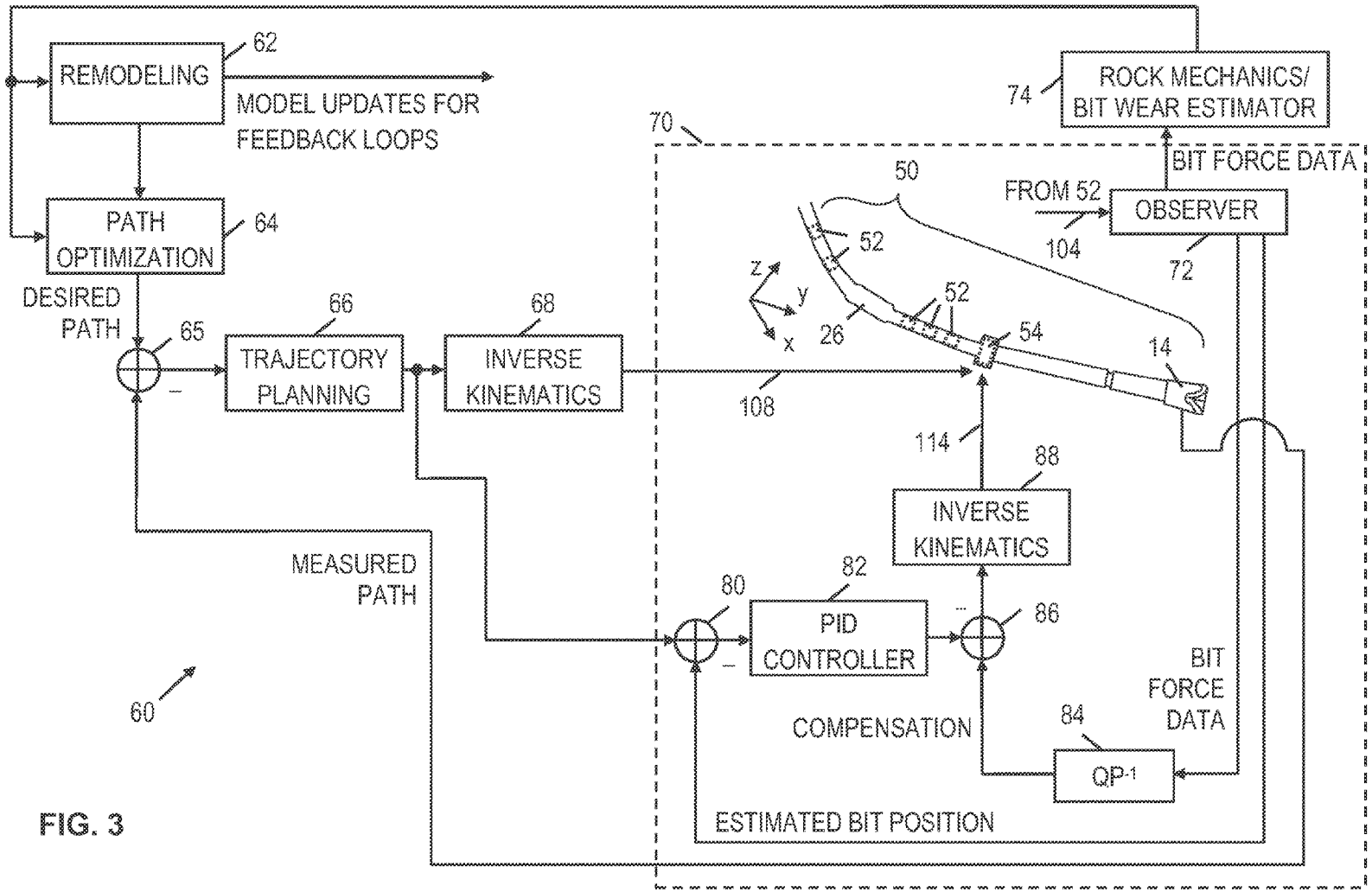
FIG. 3 is a schematic diagram showing a directional drilling control process.

FIG. 3 shows an illustrative directional drilling control process 60. In process 60, a BHA 50 with logging tool 26, sensors 52, steering tool 54, and drill bit 14 is represented. During drilling by the BHA 50, strain and/or movement measurements (e.g., the set of measurements 104) are collected by sensors 52 and are provided to observer block 72. More specifically, the set of measurements 104 may include real-time strain force measurements and acceleration measurements in the x, y, z directions. Further, the set of measurements 104 may include real-time strain force measurements is a rotational direction. The set of measurements 104 may also include real-time measurements of tension, torsion, bending, and vibration at a drill collar and/or points along BHA 50. The data resolution corresponding to the set of measurements 104 may be adjusted by adding or reducing the number of sensors 52 deployed. Further, the position of the sensors 52 and/or the design of BHA 50 may be adjusted to facilitate collecting a suitable set of measurements 104.

Figure 4:
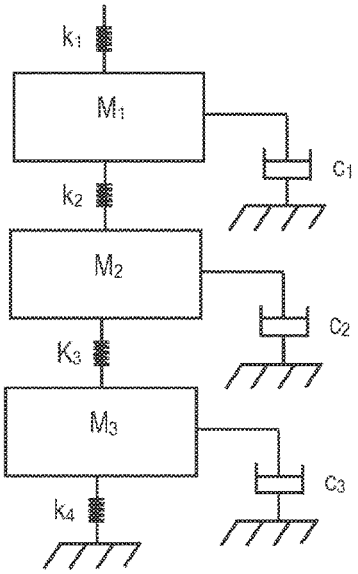
FIG. 4 is a schematic diagram showing a bottomhole assembly (BHA) dynamics model.

The observer block 72 determines bit force data from the set of measurements 104 collected by sensors 52 and forwards the bit force data to inverse dynamics block 84. In at least some embodiments, the observer block 72 employs a BHA model to estimate the bit position and bit force based on the set of measurements 104 (e.g., acceleration/strain force/torque measurements). For example, the BHA model may represent BHA 50 as a linear model composed of N mass-spring-dampers as in FIG. 4. More specifically, the BHA dynamic model is decomposed into x, y, z directions, as well as torsional directions, where the simplified 3-mass BHA model in FIG. 4 may be used for each direction. In FIG. 4, the top mass ($M_1$) represents mass of a drill collar in a given direction, the middle mass ($M_2$) represents mass of a pipe between the drill collar and drill bit 14 in a given direction, and the lower mass ($M_3$) represents mass of the drill bit 14 in a given direction. The three masses interact with each other along the given direction through springs $k_1$-$k_4$ and dampers $c_1$-$c_3$. In at least some embodiments, the spring and damper coefficients derived from factors such as the tension and bending interaction between parts of BHA 50, and the friction force between the BHA 50 and the borehole wall. Comparing the set of measurements 104 at different times enables tracking of a modeled bit force and modeled bit forces disturbances. Although in reality the drilling dynamics is nonlinear, the approximation provided by a linear model with adjustable parameters (e.g., the BHA model of FIG. 4) is sufficiently accurate for the directional drilling application described herein. As an example, the model parameters may be updated over time when the model residues and/or when the rate of change of the model residues exceed a predefined threshold.

Returning to FIG. 3, the observer block 72 also is configured to estimate a bit position based on the set of measurements 104. To estimate a bit position using the set of measurements 104, a surveyed bit position is used as an initial estimate. When the bit accelerations and bending moments along its principal axes are available from the set of measurements 104, the linear system representing BHA dynamics is observable (e.g., the BHA model of FIG. 4 can be used). Since the BHA 50 is subject to both process and measurement noises, a Kalman filter can be adopted to optimize the bit position estimate. Whenever MWD survey data is available, the initial condition for the bit position is reset accordingly, then the Kalman filter is used to estimate the bit position in real-time until the next MWD survey is available. The difference between the bit position measured using MWD survey data and the estimated bit position can be used to calibrate the Kalman filter and sensor characteristics. Such calibrations may adjust the noise statistics specified in the Kalman filter and the sensor bias estimation so that the estimation accuracy is improved as the drilling process progresses.

The bit position estimated by the observer block 72 is forwarded to comparison logic 80, where the difference between a desired bit position and the estimated bit positioned is provided as input to PID controller 82. The PID controller 82 uses the difference between the desired bit position and the estimated bit position to output an adjusting force that will direct the drill bit 14 toward the desired path. In at least some embodiments, the PID controller design accounts for dogleg severity or tortuosity constraints. The output of the PID controller 82 is forwarded to comparison logic 86, which compares the PID controller output with a bit force disturbance compensation output from inverse dynamics block 84. For the inverse dynamics block 84, "P" denotes the transfer function from the steering tool 54 to the drill bit 14, and the transfer function "Q" is predesigned such that $QP^{-1}$ approximates the reverse dynamics of the drilling system. The output of the inverse dynamics block 84 corresponds to a bit force disturbance compensation that prevents the PID controller from reacting to bit disturbance forces, improving the drilling control stability. As shown, the difference between the PID controller output and the bit force disturbance compensation is forwarded to inverse kinematics block 88, which outputs steering control signal 114 to steering tool 54. In at least some embodiments, the steering tool 54 is configured to adjust the direction of drill bit 14 (and thus the drilling direction) in real-time based on the drilling control signal 114. The drill bit direction adjustment can be achieved, for example, by changing cam positions of the steering tool 54 to bend BHA 50.

Figure 5A:
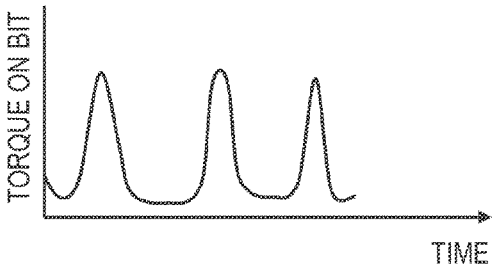
FIGS. 5A-5C are graphs showing drilling diagnosis examples.
Figure 5B:
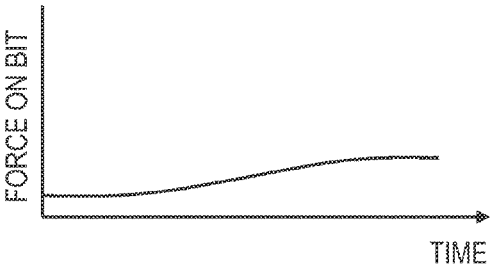
Figure 5C:
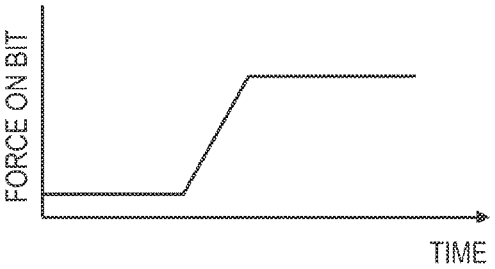

The steering tool 54 is also configured to adjust the direction of drill bit 14 (and thus the drilling direction) in real-time based on the drilling control signal 108. As shown, the drilling control signal 108 is the result of a feedback loop, where the observer block 72 receives the set of measurements 104 from sensors 52 and outputs bit force data to rock mechanics/bit wear estimator 74. The rock mechanics/bit wear estimator 74 may operate in real-time to detect rock changes or bit wear. FIGS. 5A-5C and FIG. 6 show various charts related to bit force disturbances, rock changes and/or bit wear that may be detected by the rock mechanics/bit wear estimator 74. In FIG. 5A, a varying torque on bit with multiple peaks as a function of time as shown is indicative of stick-slip issues. In FIG. 5B, a slow increase in the force on bit as a function of time as shown is indicative of bit wear. In FIG. 5C, a rapid increase in the force on bit as a function of time as shown is indicative of a formation change.

Figure 6:
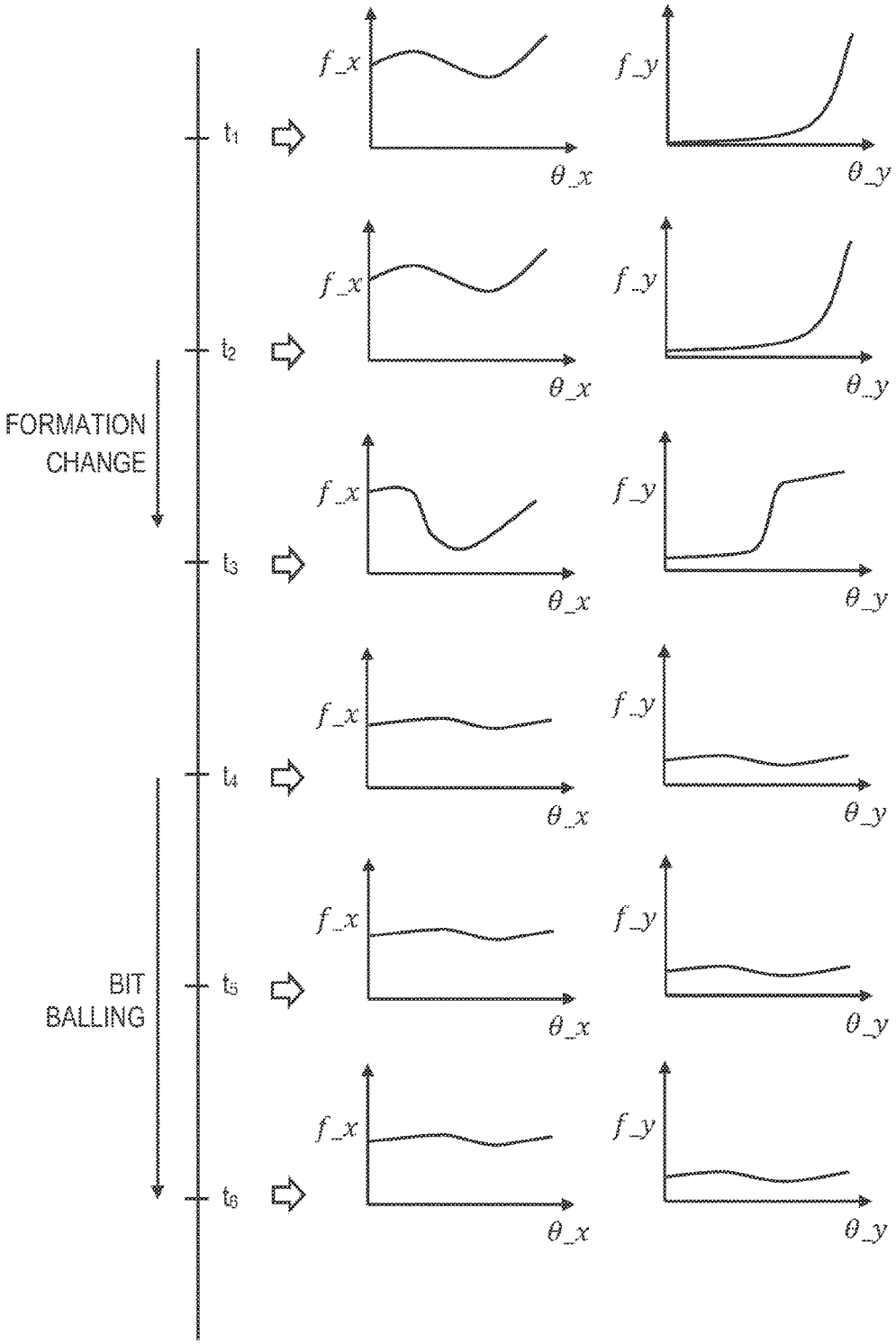
FIG. 6 is a combination of graphs showing rock mechanics analysis.

In FIG. 6, the charts represent detectable faults based on bit force observation. More specifically, the reactive bit force can be inspected by perturbing the bending of BHA 50. The perturbation is performed, for example, by the steering tool 54 at various bending angles along the x and y directions. The relationship between the bending angles and the estimated bit force can be characterized at different times, $t_1$-$t_6$, during drilling. Although the different times, $t_1$-$t_6$, are shown to be evenly spaced, such analysis may be performed using different time intervals and/or unevenly spaced time intervals. For each of the different times, two charts illustrating the force on bit (ƒ_x) as a function of direction (θ _x or θ _y) are shown, and represent rock hardness along different directions. When drilling proceeds in one formation, the force on bit curves for each direction usually stay the same as shown for times $t_1$ and $t_2$. At $t_3$, sudden changes to both charts are indicative of a formation change. Meanwhile, the flatter curves shown for times $t_4$-$t_6$ are indicative of bit balling. Analysis of force on bit curves such as those shown for FIG. 6 is one way to select drilling adjustments. For example, with knowledge of a bit force/bending angle relationship, directional drilling updates can pursue easier to drill paths (reducing energy consumption and bit wear).

The output of the rock mechanics/bit wear estimator block 74 is forwarded to remodeling block 62 and path optimization block 64. In at least some embodiments, the remodeling block 62 updates one or more models or model parameters used for the first and second feedback loops to reduce the amount of error in process 60. For example, the remodeling block 62 may update a model or model parameters used by the observer block 72 to represent BHA dynamics (e.g., the BHA model related to FIG. 4). The BHA model enables a bit force, bit force disturbance, and/or bit position to be estimated from the set of measurements 104 collected by sensors 52. Further, the remodeling block 62 may update the transfer function "P" and/or "Q" used by the inverse dynamics block 84. Further, the inverse kinematics blocks 68 and 88 may be updated. The path optimization block 64 may also be updated by remodeling block 62. The updates provided by the remodeling block 62 may be automated or may involve an operator (e.g., via a user interface that displays data, selectable model options, and/or simulated results of model changes)

Before or after being updated, the path optimization block 64 determines a desired borehole path based on the rock mechanics and/or bit wear results output from block 74 as well as drilling status constraints and environmental constraints. This desired path is compared with a measured path by comparison logic 65, where the measured path is determined from MWD survey data. The difference between the desired path and the measured path is forwarded from comparison logic 65 to trajectory planning block 66, which determines a desired bit position and/or other drilling trajectory updates. If the difference between the desired path and the measured path is less than a threshold, the trajectory planning block 66 may simply maintain the current trajectory or do nothing. If a trajectory change is needed, the desired bit position or trace (e.g., in short time, short trajectory, or low dogleg severity format) is forwarded to inverse kinematics blocks 68, which translates the desired bit position or trace to drilling control signal 108 (e.g., cam positions) for the drilling tool 54. The desired bit position is also forwarded to comparison logic 80, which compares the desired bit position with an estimated bit position as described previously.

The various components described for process 60 may correspond to software modules, hardware, and/or logic, that reside either downhole or at earth's surface. For example, in some embodiments, all of the components within box 70 correspond to downhole components, while the other components correspond to surface components. In different embodiments, the rock mechanics/bit wear estimator block 74 may correspond to a downhole component or a surface component.

Further, the components described for process 60 may be understood to be part of the first and second feedback loops described herein. For example, in some embodiments, all of the components within box 70 are part of the second feedback loop, while the other components are part of the first feedback loop. The observer block 72 may be considered part of both the first and second feedback loops. Alternatively, separate observer blocks may be used for the first and second feedback loops. In such case, the observer block for the second feedback loop determines bit force and an estimated bit position, while the observer block for the first feedback loop determines bit force.

In the process 60, the drilling dynamics is partitioned into fast and slow time scales. More specifically, updates to drilling control signal 108 corresponds to a slow time scale, while updates to drilling control signal 114 corresponds to a fast time scale. For example, the drilling control signal 108 may be updated whenever path deviation beyond a threshold occurs, while the drilling control signal 114 is updated in real-time at a rate of at least 10 times per second. This partitioning is according to the nature of the drilling dynamics, environmental changes, as well as data accessibility. The slow time scale updates are related to the first feedback loop described herein and correspond to slowly changing dynamics including the drill string model, the bit wear model, the rock mechanics model, the drilling path design, as well as MWD survey updates. The fast time scale updates are related to the second feedback loop described herein, and correspond to fast changing dynamics including the bit dynamics (bit force and bit position) and the steering tool 54 control mechanism. To enable the fast time scale updates, the observer block 72 should be located downhole (e.g., with BHA 50) to estimate both the bit force and the bit position in real-time. Moreover, the PID controller 82 should be located downhole (e.g., with BHA 50) to correct path deviations in real-time. While the reference drilling path (the output of trajectory planning block 66) used by the PID controller 82 is updated based on the slow time scale, the bit force disturbance compensation provided by the inverse dynamics block 84 is updated based on the fast time scale and improves stability of the PID controller 82.

Figure 7:
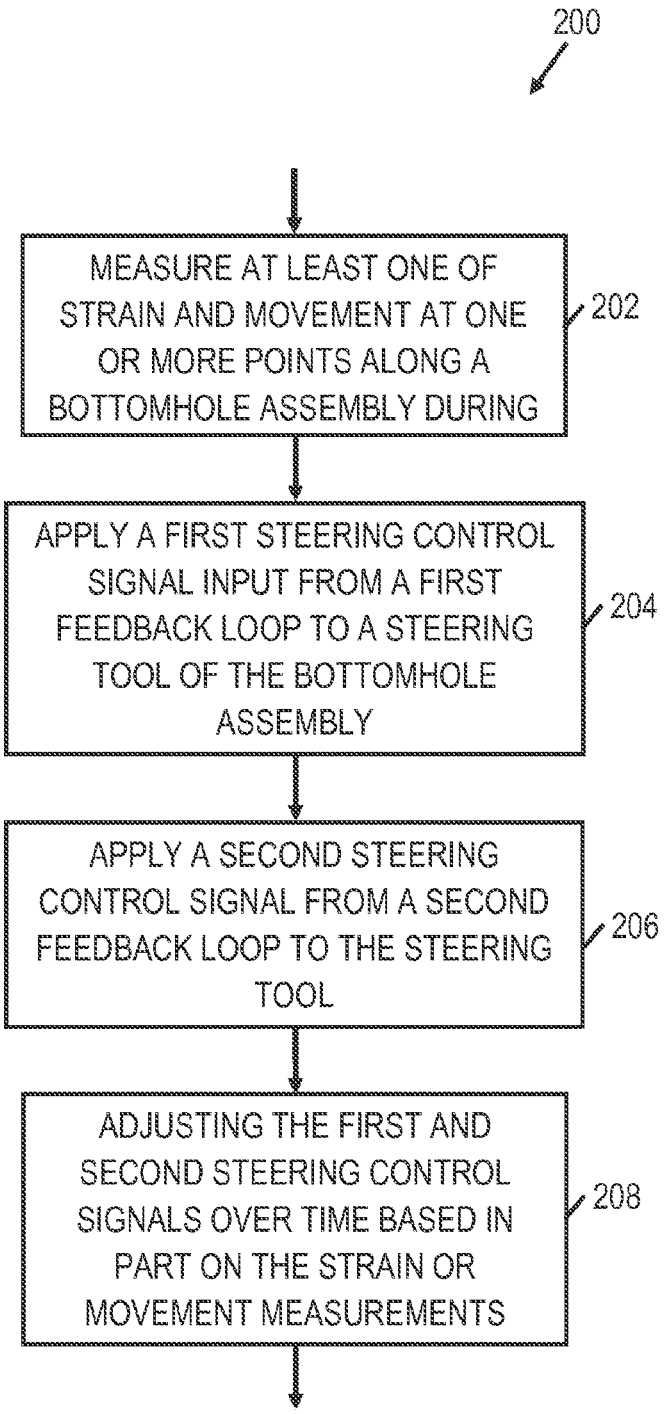
FIG. 7 is a flowchart showing a directional drilling method.

FIG. 7 shows an illustrative directional drilling method 200. In method 200, strain and/or movement is measured at one or more points along a BHA during drilling (block 202). At block 204, a first control signal is applied from a first feedback loop to a steering tool of the BHA. At block 206, a second control signal is applied from a second feedback loop to the steering tool. At block 208, the first and second steering control signals are adjusted over time based on the strain or movement measurements.

Embodiments disclosed herein include:

A: A directional drilling system that comprises a bottomhole assembly having a drill bit and a steering tool configured to adaptively control a drilling direction. The system further comprises a first feedback loop that provides a first control signal to the steering tool, and a second feedback loop that provides a second control signal to the steering tool. The system further comprises a set of sensors to measure at least one of strain and movement at one or more points along the bottomhole assembly during drilling, wherein the first and second steering control signals are based in part on the strain or movement measurements.

B: A directional drilling method that comprises measuring at least one of strain and movement at one or more points along a bottomhole assembly during drilling. The method further comprises applying a first control signal from a first feedback loop to a steering tool of the bottomhole assembly, and applying a second control signal from a second feedback loop to the steering tool. The method further comprises adjusting the first and second control signals over time based in part on the strain or movement measurements.

Each of the embodiments, A and B, may have one or more of the following additional elements in any combination. Element 1: the second feedback loop comprises logic that estimates a bit position and at least one of a bit force and a bit force disturbance based in part on the strain or movement measurements. Element 2: the second feedback loop comprises logic estimates a bit force disturbance compensation based on the estimated bit force or bit force disturbance. Element 3: the bit force disturbance compensation is applied to a PID controller output, wherein the PID controller receives as input a difference between a desired bit position and the estimated bit position. Element 4: the first feedback loop comprises logic that estimates at least one of a bit force and a bit force disturbance based in part on the strain or movement measurements. Element 5: the first feedback loop comprises logic that estimates at least one of rock mechanics and bit wear based on the estimated bit force or bit force disturbance. Element 6: the first feedback loop comprises a borehole path optimizer to determine a desired borehole path based in part on the estimated rock mechanics or drill bit wear. Element 7: the first control signal is updated whenever path deviation beyond a threshold occurs, and wherein the second control signal is updated at a fixed rate. Element 8: the first feedback loop determines the first control signal based in part on a difference between a desired borehole path and a measured borehole path. Element 9: further comprising logic to update models or model parameters used by the first feedback loop and the second feedback loop.

Element 10: further comprising estimating, by the second feedback loop, a bit position and at least one of a bit force and a bit force disturbance based in part on the strain or movement measurements. Element 11: further comprising estimating, by the second feedback loop, a bit force disturbance compensation based on the estimated bit force or bit force disturbance. Element 12: further comprising applying, by the second feedback loop, the bit force disturbance compensation to a PID controller output; and receiving as input, by the PID controller, a difference between a desired bit position and the estimated bit position. Element 13: further comprising estimating, by the first feedback loop, at least one of a bit force and a bit force disturbance based in part on the strain or movement measurements. Element 14: further comprising estimating, by the first feedback loop, at least one of rock mechanics and drill bit wear based on the estimated bit force or bit force disturbance. Element 15: further comprising determining, by the first feedback loop, a desired borehole path based on the estimated rock mechanics or drill bit wear. Element 16: further comprising adjusting the first control signal whenever path deviation beyond a threshold occurs, and adjusting the second control signal at a fixed rate. Element 17: further comprising periodically updating models or model parameters used by the first feedback loop and the second feedback loop. Element 18: further comprising determining the first control signal based in part on a difference between a desired borehole path and a measured borehole path.

Numerous variations and modifications will become apparent to those skilled in the art once the above disclosure is fully appreciated. It is intended that the following claims be interpreted to embrace all such variations and modifications.

What is claimed is:

1. A directional drilling system, comprising:

a bottomhole assembly having a drill bit and a steering tool configured to adaptively control a drilling direction;

a first feedback loop that provides a first control signal to the steering tool;

a second feedback loop that provides a second control signal to the steering tool; and a set of sensors to measure at least one of strain and movement at one or more points along the bottomhole assembly during drilling, wherein the first and second control signals are based in part on the strain or movement measurements, wherein the second feedback loop comprises logic that estimates a bit position and at least one of a bit force and a bit force disturbance based in part on the strain or movement measurements, and, wherein the second feedback loop comprises logic that estimates a bit force disturbance compensation based on the estimated bit force or bit force disturbance.

2. The system of claim 1, wherein the bit force disturbance compensation is applied to a PID controller output, and wherein the PID controller receives as input a difference between a desired bit position and the estimated bit position.

3. The system of claim 1, wherein the first feedback loop comprises logic that estimates at least one of a bit force and a bit force disturbance based in part on the strain or movement measurements.

4. The system of claim 3, wherein the first feedback loop comprises logic that estimates at least one of rock mechanics and bit wear based on the estimated bit force or bit force disturbance.

5. The system of claim 4, wherein the first feedback loop comprises a borehole path optimizer to determine a desired borehole path based in part on the estimated rock mechanics or drill bit wear.

6. The system of claim 1, wherein the first control signal is updated whenever path deviation beyond a threshold occurs, and wherein the second control signal is updated at a fixed rate.

7. The system of claim 1, wherein the first feedback loop determines the first control signal based in part on a difference between a desired borehole path and a measured borehole path.

8. The system of claim 1, further comprising logic to update models or model parameters used by the first feedback loop and the second feedback loop.

9. A directional drilling method, comprising:

measuring at least one of strain and movement at one or more points along a bottomhole assembly during drilling;

applying a first control signal from a first feedback loop to a steering tool of the bottomhole assembly;

applying a second control signal from a second feedback loop to the steering tool;

adjusting the first and second control signals over time based in part on the strain or movement measurements;

estimating, by the second feedback loop, a bit position and at least one of a bit force and a bit force disturbance based in part on the strain or movement measurements; and estimating, by the second feedback loop, a bit force disturbance compensation based on the estimated bit force or bit force disturbance.

10. The method of claim 9, further comprising:

applying, by the second feedback loop, the bit force disturbance compensation to a PID controller output; and receiving as input, by the PID controller, a difference between a desired bit position and the estimated bit position.

11. The method of claim 9, further comprising estimating, by the first feedback loop, at least one of a bit force and a bit force disturbance based in part on the strain or movement measurements.

12. The method of claim 11, further comprising estimating, by the first feedback loop, at least one of rock mechanics and drill bit wear based on the estimated bit force or bit force disturbance.

13. The method of claim 12, further comprising determining, by the first feedback loop, a desired borehole path based on the estimated rock mechanics or drill bit wear.

14. The method of claim 9, further comprising:

adjusting the first control signal whenever path deviation beyond a threshold occurs; and adjusting the second control signal at a fixed rate.

15. The method of claim 9, further comprising periodically updating models or model parameters used by the first feedback loop and the second feedback loop.

16. The method of claim 9, further comprising determining the first control signal based in part on a difference between a desired borehole path and a measured borehole path.

* * * * *